US008166968B2

(12) United States Patent
Garraffa

(10) Patent No.: US 8,166,968 B2
(45) Date of Patent: May 1, 2012

(54) SCUPPER VALVE SNORKEL

(75) Inventor: Dean R. Garraffa, Newport Coast, CA (US)

(73) Assignee: Atomic Aquatics, LLC, Salt Lake City, UT (US)

( * ) Notice: Subject to any disclaimer, the term of this patent is extended or adjusted under 35 U.S.C. 154(b) by 1173 days.

(21) Appl. No.: 11/593,420

(22) Filed: Nov. 6, 2006

(65) Prior Publication Data

US 2008/0105254 A1 May 8, 2008

(51) Int. Cl.

| | |
|---|---|
| ***B63C 11/10*** | (2006.01) |
| ***B63C 11/16*** | (2006.01) |
| ***B63C 11/02*** | (2006.01) |
| ***A62B 7/00*** | (2006.01) |
| ***A62B 18/08*** | (2006.01) |
| ***A62B 18/10*** | (2006.01) |
| ***A61M 11/00*** | (2006.01) |

(52) U.S. Cl. ..... 128/201.11; 128/201.27; 128/200.25; 128/200.23; 128/200.29; 128/201.19; 128/201.28; 405/186; 405/187

(58) Field of Classification Search ..... 128/201.11, 128/201.27, 200.25, 200.23, 200.29, 201.19, 128/201.28; 405/186, 187

See application file for complete search history.

(56) References Cited

U.S. PATENT DOCUMENTS

| | | | | |
|---|---|---|---|---|
| 4,278,080 | A | 7/1981 | Schuch | |
| 4,884,564 | A | 12/1989 | Lamont | |
| 4,928,710 | A | 5/1990 | Campbell | |
| 5,117,817 | A | 6/1992 | Lin | |
| 5,261,396 | A | 11/1993 | Faulconer | |
| 5,671,728 | A * | 9/1997 | Winefordner et al. | 128/201.11 |
| 5,868,129 | A | 2/1999 | Christianson | |
| 6,119,685 | A | 9/2000 | Kawashima et al. | |
| 6,302,102 | B1 | 10/2001 | Giroux | |
| 7,032,591 | B2 | 4/2006 | Monnich | |
| 7,047,965 | B1 | 5/2006 | Ball | |
| 2005/0051164 | A1 * | 3/2005 | Hutter et al. | 128/201.11 |

* cited by examiner

*Primary Examiner* — Patricia Bianco
*Assistant Examiner* — Nihir Patel
(74) *Attorney, Agent, or Firm* — Austin Rapp & Hardman

(57) ABSTRACT

A conjoined tube within a tube located inside a lower section of a snorkel designed to steer water droplets away from the snorkel diver's breathing path. The lower section of the snorkel has two valves. One is the scupper valve positioned at the lowest point of the inside tube. The scupper valve is a light duty valve or a low resistance one-way watertight passage intended to allow droplets of water to drain into the main reservoir. The outer tube lower section contains a reservoir for holding residual water that travels down to the bottom of the snorkel and is contained therein. During the normal clearing operation, the reservoir can be emptied and water will exit out of the lower section and into the surrounding water.

6 Claims, 4 Drawing Sheets

SCUPPER VALVE SNORKEL

BACKGROUND OF THE INVENTION

1. Field of the Invention

The present invention relates generally to a diver's snorkel and more particularly to a uniquely configured snorkel mouthpiece section which is designed to minimize the collection of water in the mouthpiece.

2. Background Art

A snorkel diver may encounter rough surface conditions such as splashing, waves or surface wind chop. As a result, water in the form of droplets will enter the open top of the snorkel tube or conduit and make their way down the walls of the tube or conduit toward the mouthpiece at the lower end. The resulting accumulation of sea water in the mouthpiece requires the diver to either purge the snorkel or remove the mouthpiece and turn it into an inverted position so that the accumulated water can drain out. Frequent purging or removal of the mouthpiece can be an annoying and inconvenient distraction which can substantially reduce the enjoyment of snorkel diving.

Therefore, there have been frequent prior art attempts to construct a snorkel so that water droplets do not enter the mouthpiece. By way of example:

U.S. Pat. No. 4,884,564 to Lamont is directed to a mechanism for more efficient purging of the water column and more efficient water drainage to enhance snorkel breathing. This snorkel patent utilizes one or more of the following features: a trough in the partition between the breathing tube and the purge conduit using a hole to drain water and prevent back flow; a deflector on the mouthpiece side of the partition to resist water flow towards the mouthpiece and promote drainage through a hole in the partition; a Venturi-type construction in the breathing tube to increase water pure in efficiency for a given exhalation effort; as well as decrease resistance to the air flow to the user; and an air trap immediately exterior to the purge valve and the branch conduit for reducing the resistance to opening of the valve and thus promoting drainage of residual water in the branch conduit.

U.S. Pat. No. 4,278,080 to Schuch is directed to a diving snorkel provided with a purge valve located in a branch conduit. This snorkel contains a large purge valve at the end of the branch conduit that connects with the snorkel tube at a place spaced substantially from the snorkel mouthpiece. The location of the purge valve prevents the premature venting of air that the water is effectively purged before any significant slippage occurs between the impelling air and the impelled water.

U.S. Pat. No. 5,868,129 to Christianson is directed to a snorkel having a conduit with an open end above the water surface and an underwater end which terminates in a collapsible chamber. A mouthpiece adjacent and above the chamber provides a flow path between the conduit and the interior of the diver's mouth. A check-valve in the opening between the conduit and the chamber allows water to flow between the conduit and the chamber but not in the reverse direction. The chamber also has a purge valve which allows water in the chamber to flow to ambient. Note that when hydrostatic pressure within the snorkel is greater than ambient, water will flow sequentially through the check-valve, chamber and purge valve to ambient.

U.S. Pat. No. 5,261,396 Faulconer et al is directed to a snorkel purge valve system incorporating an elongated chamber uniquely offset at an angle from the axis of the mouthpiece and having an introductory conduit for connection to an elongated tube of a snorkel. The elongated tube has an opening at one end of the inlet and outlet of breathing air. A mouthpiece is provided at the other end that is connected to the elongated tube by means of a fitting. The fitting can be in the form of a connection member incorporating the purge system. The mouthpiece contains grooves or flanges received on a mouthpiece mounting member for attachment. An outlet purge chamber is connected to the mouthpiece in an orientation such that it allows for drainage of water to flow there into, rather than the mouthpiece. The purge chamber has a purge valve distal from the mouthpiece and incorporates a chamber of significant volume for drainage from the mouthpiece and the elongated tube. The purge conduit has a plurality of ribs and grooves that are used to provide strength and can be used as a grip.

U.S. Pat. No. 4,928,710 to Campbell is directed to a mouthpiece for use with a snorkel with or without a purge valve. The snorkel includes a mouthpiece and contains a conduit in communication with an elongated breathing tube for the passage of air. The detachable snorkel mouthpiece incorporates a conduit having one or more interior grooves within the interior seating portion thereof. A tubular snorkel breathing extension having one or more exterior flanges engages the interior grooves which allows a firm fitting of the snorkel mouthpiece to the snorkel.

U.S. Pat. No. 5,117,817 to Lin discloses a snorkel having a tube within a tube configuration. The concentric tube configuration does not extend down to the mouthpiece and they are for intake and exhaust, respectively.

U.S. Pat. No. 6,302,102 to Giroux et al discloses a dry snorkel having dual side-by-side inner chambers leading to upper end check valves for inlet and exhaust, respectively.

U.S. Pat. No. 7,032,591 to Monnich discloses a snorkel having a walled lower purge area near the mouthpiece as shown best in FIG. 4.

U.S. Pat. No. 7,047,965 to Ball discloses a front-mounted snorkel having side-by-side tubes for inlet and exhaust leading to separate upper check valves.

Each of these prior art attempts has proven to be less than satisfactory for its intended purpose or too impractical to be built or not a commercially viable product. Therefore there is still a need for a practical solution which results in a snorkel having the ability to resist accumulation of water in the mouthpiece.

SUMMARY OF THE INVENTION

The scupper valve snorkel of the present invention is based on a conjoined tube within a tube located inside a lower section of a snorkel and designed to steer water droplets away from the snorkel diver's breathing path.

If water enters the top of the snorkel, it will cling to the side-walls of the curved and contoured shape of the main breathing tube or "barrel". As gravity forces it to travel down the barrel to the bottom of the snorkel, it arrives at a freestanding internal tube. The freestanding tube also serves as the snorkel diver's airway path to the top of the snorkel. With diametrical clearance around its perimeter, the freestanding tube allows water to pass by its opening. This is due mainly to the water droplets clinging to the side-wall of the barrel. If enough of a gap or diametrical clearance is provided at the intersection of a barrel and a freestanding tube, a "capillary type action occurs" as water continues into the gap and downward into a reservoir at the very bottom of the snorkel.

The lower section of the snorkel has two valves. One is the scupper valve positioned at the lowest point of the inside tube. The scupper valve is designed as a light duty valve or a low resistance one-way watertight passage intended to allow droplets of water to drain into the main reservoir. This must occur without build up or trapping of water that could otherwise be drawn into the breathing path of the snorkel diver.

The outer tube lower section contains a reservoir for holding residual water that travels down to the bottom of the snorkel and is contained therein. During the normal clearing operation, the reservoir can be emptied and water will exit out of the lower section and into the surrounding water.

If the snorkel diver floods the snorkel completely with water, it is emptied by blowing air from the mouth into the snorkel mouthpiece hole. Commonly referred to as "clearing the snorkel", a sharp blast of air is expelled quickly from the snorkel diver to create a positive pressure wave inside the snorkel.

As the positive air pressure wave travels from the bottom of the flooded snorkel to the top, most of the water inside the tube exits the top of the snorkel where a scavenging effect is created. This effect tends to "pull" the water out as a continuous column as pressure below the column "pushes". Some of the water also exits out of the lower purge valve positioned at the lowest point of the snorkel. It is important not to block or impede the path of column water at the top of the snorkel and break the smooth flow of the water as it exits the barrel. Otherwise, a significant amount of water fails to exit the barrel and returns down again to the lower section and overflows the lower reservoir.

If clearing the snorkel is done effectively, it is still possible that some small droplets of water will remain inside and cling to the barrel walls and the standing tube. This water drains to the scupper valve and passes into the reservoir keeping the breathing path clear and dry.

The inside main breathing tube provides a radial clearance path or gap between the inside tube and outer tube to channel water that enters the top of the snorkel down to a lower section water reservoir without entering the main breathing tube mouthpiece hole. The inside tube also has at its lowest point, a scupper style drain system intended to drain away droplets of water from the main breathing tube and into the water reservoir. The reservoir has at its lowest point a non-return valve to empty any water that it contains. The principal features of the preferred embodiment include the following: An inside tube is located inside a lower snorkel section. The outer tube section is co-axial to the inside tube and is interconnected to it by a common wall. The inside tube is separated by a conjoined wall and communicates into and through a mouthpiece opening hole to the snorkel diver breathing path. A scupper non-return valve is located at the lowest draining end of the inside tube. A second non-return valve is located at the lowest draining end of the outside tube. A reservoir is used to retain excess water. A gap or diametrical clearance between the inside tube and the outside tube steers water droplets away from the mouthpiece and into a lower section away from the diver's mouth.

BRIEF DESCRIPTION OF THE DRAWINGS

The various embodiments, features and advances of the present invention will be understood more completely hereinafter as a result of a detailed description thereof in which reference will be made to the following drawings.

DETAILED DESCRIPTION OF A PREFERRED EMBODIMENT

Figure 1:
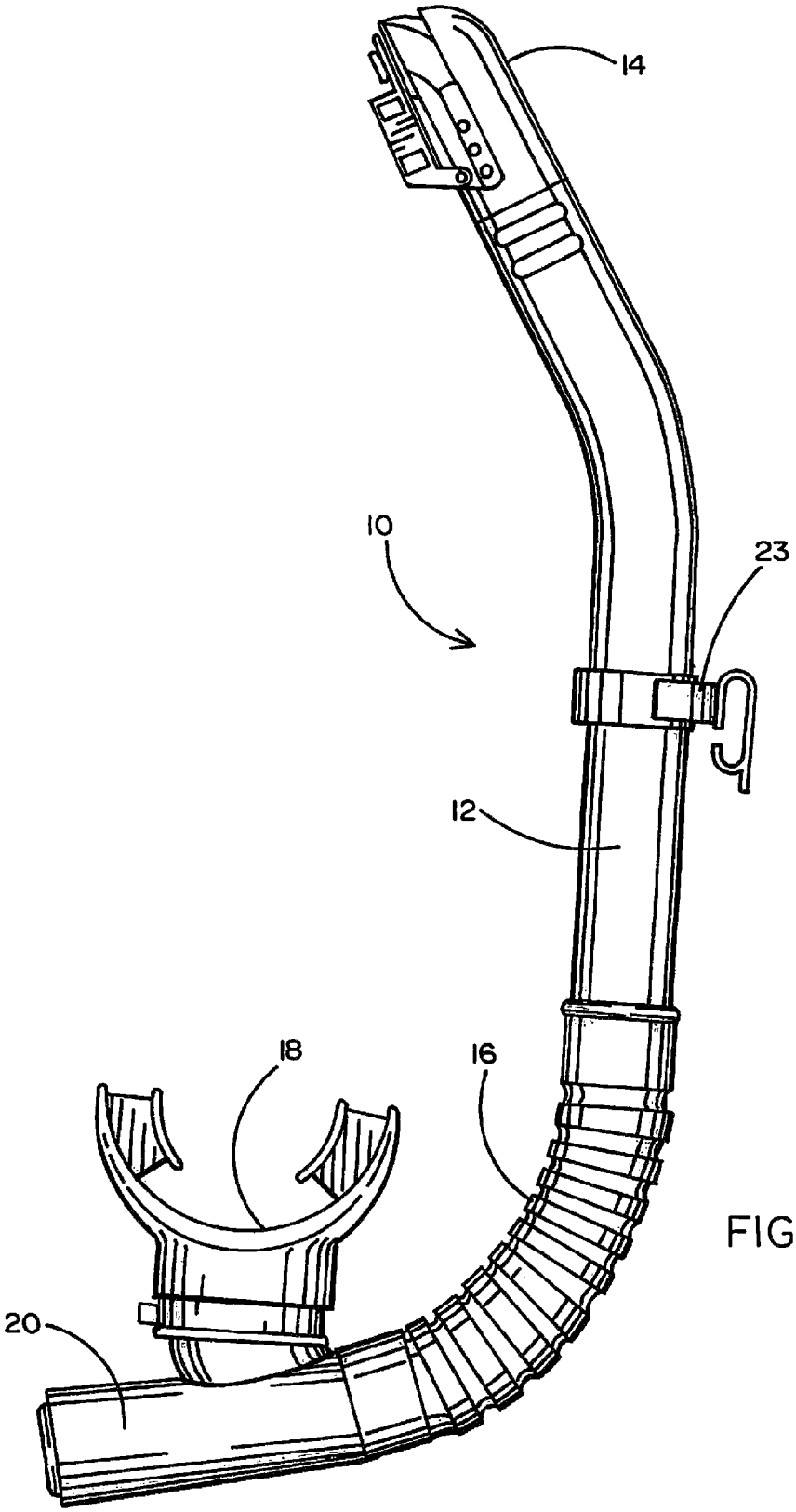
FIG. 1 is a view of an entire snorkel in which the preferred embodiment of the present invention is utilized.
Figure 2:
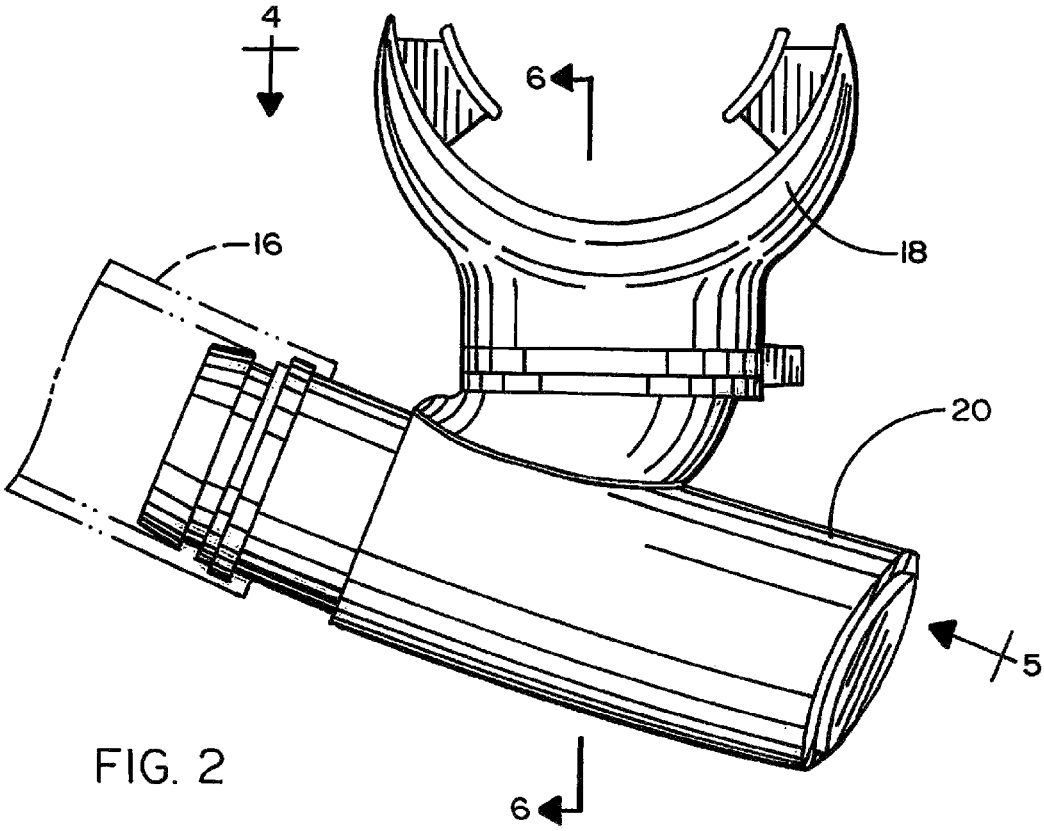
FIG. 2 is an enlarged view of the lower section of the snorkel of FIG. 1.

Referring to the accompanying drawings it will be seen a snorkel 10 comprises an elongated barrel or conduit 12 having a top end 14, a flexible section 16 and a mouthpiece 18 connected to a lower section tube 20. A mask clip 23 may be provided to attach to a dive mask strap (not shown).

Figure 3:
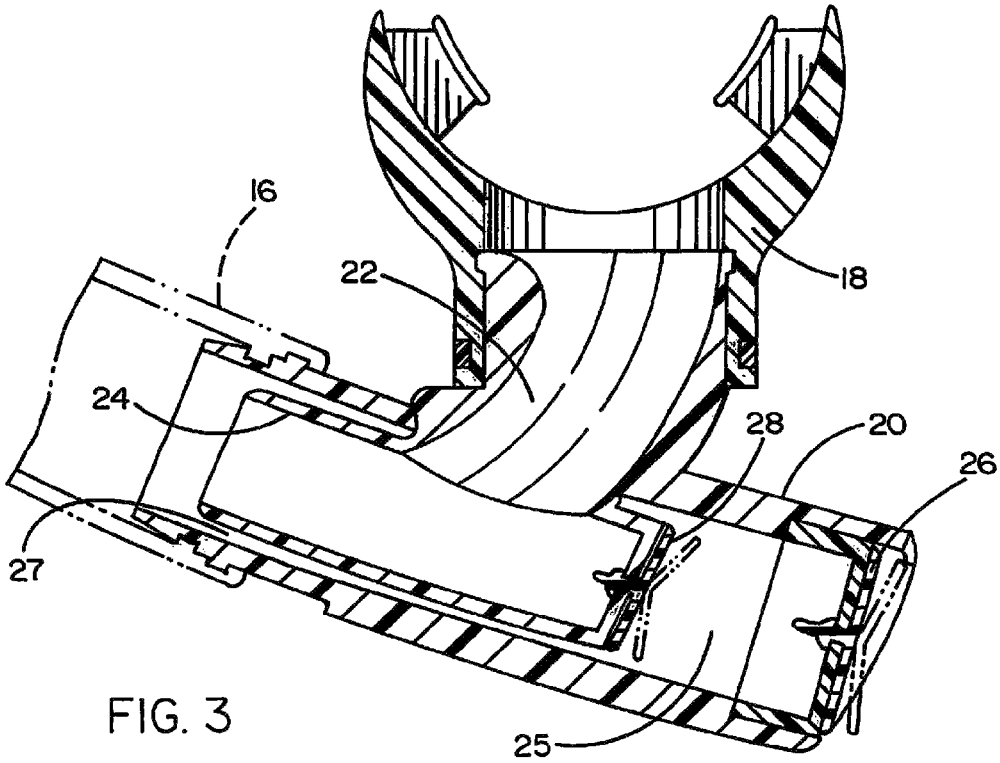
FIG. 3 is a cross-sectional view of the lower section of FIG. 2.
Figure 4:
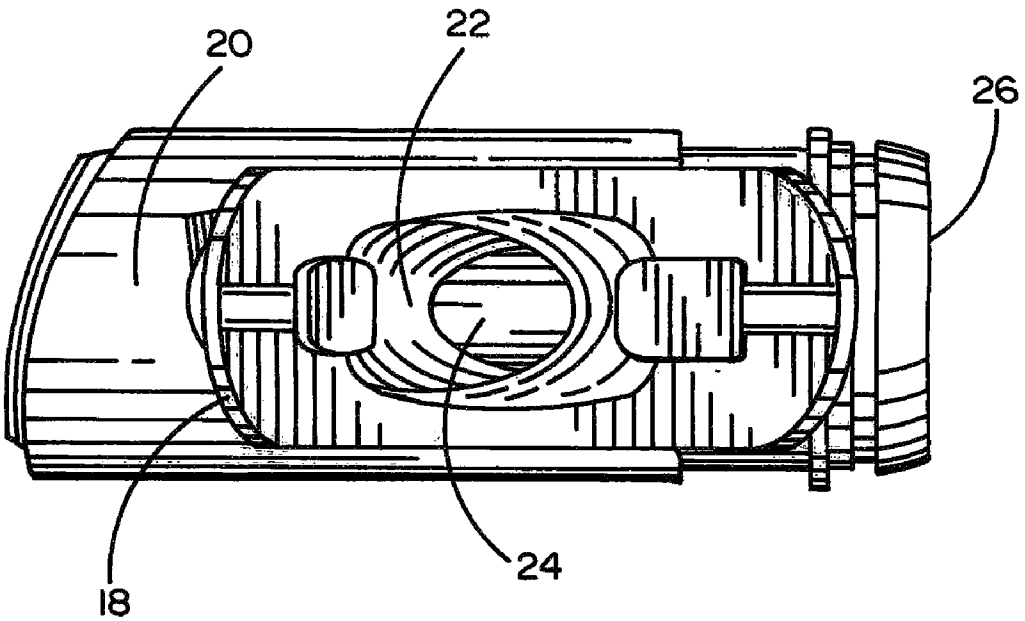
FIG. 4 is a view of the lower section taken along the direction shown in FIG. 2 by the number 4 arrow.
Figure 6:
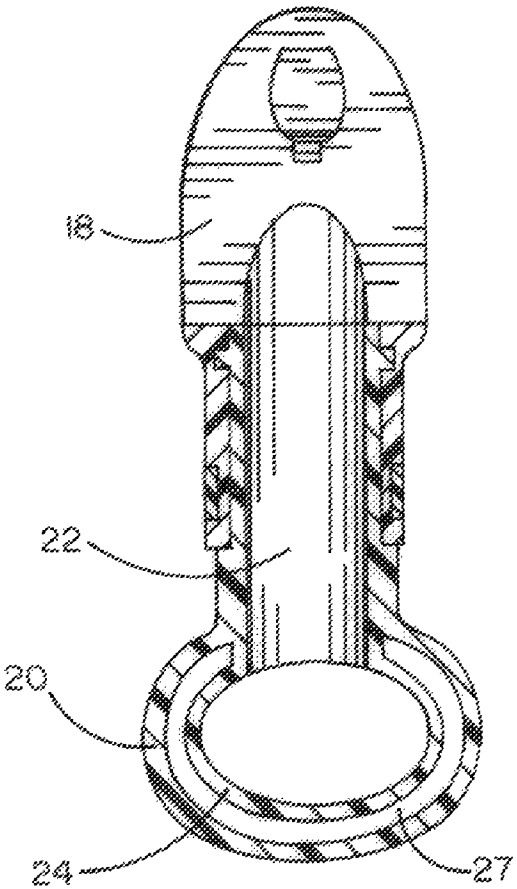
FIG. 6 is a cross-sectional view taken along lines 6-6 of FIG. 2.
Figure 5:
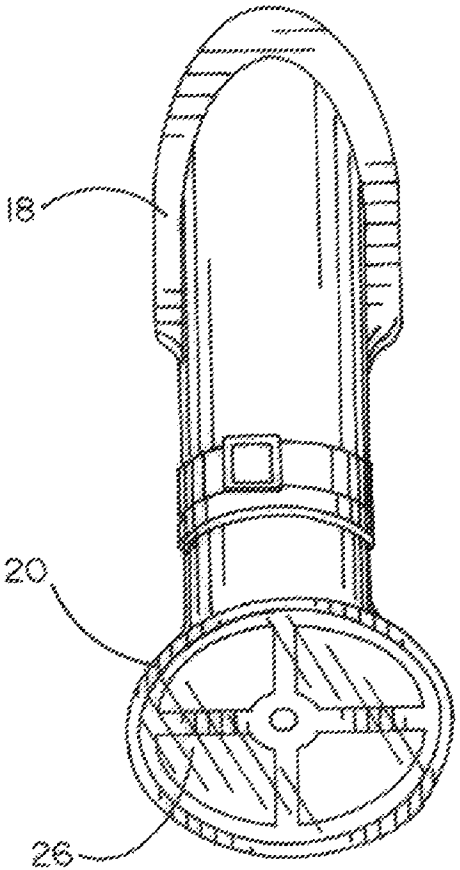
FIG. 5 is a view of the lower section taken along the direction shown in FIG. 2 by the number 5 arrow.

As shown best in FIGS. 3 and 6, the mouthpiece 18 is connected through a mouthpiece tube 22 through the wall of tube 20 to an inside tube 24 which resides coaxially within the outside tube 20 forming a radial gap 27 therebetween.

The lower end of the inside tube 24 terminates in an inner one-way valve or scupper valve 28 which leads to an inside drain reservoir 25 at the lower end of outside tube 20. Outside tube 20 terminates in an outer one-way valve 26 which leads to the surrounding ambient environment which will typically be the surrounding sea water.

Those who are familiar with the snorkel art will recognize that the disclosed lower section structure will channel water droplets draining toward the lower section tube 20 from the flexible section 16 between the inside tube 24 and the outside tube through radial gap 27 and into reservoir 25. Therefore, such droplets will not be permitted to enter mouthpiece tube 22 and mouthpiece 18. Moreover, any droplets that make their way into inside tube 24 will exit through one-way scupper valve 28 which in turn, will be purged through one-way valve 26 into the surrounding sea water. In the event that water in the reservoir 25 begins to accumulate and extends above the lower end of inside tube 24, one-way scupper valve 28 will prevent that water from entering the inside tube and the mouthpiece tube 22 until it extends above gap 27. This results in a drier mouthpiece that is less impacted by overflow at the top end of the snorkel.

It will now be understood that while a preferred embodiment has been disclosed herein, various modifications are contemplated. By way of example, the precise dimensions of the inside tube may be altered while still achieving the benefits of the inventive measures. Moreover, the uniquely configured tube within a tube design of the mouthpiece section hereof, may be highly advantageous in resisting accumulation of water in the mouthpiece even if there is no scupper valve 28, but only an opened lower end of the inside tube 24. Accordingly, the scope hereof is not to be deemed limited to the described embodiment, but instead only by the appended claims and their equivalents.

I claim:

1. In a snorkel used for breathing through a mouthpiece beneath the surface of a body of water and having a conduit with an opened top extending above the mouthpiece, a mouthpiece section for reducing accumulation of water in the mouthpiece from droplets falling along the interior surface of the conduit toward the mouthpiece, the mouthpiece section comprising:

an outer tube and an inner tube extending co-axially within said outer tube; and a mouthpiece tube connecting said mouthpiece to said inner tube through a radial portion of said outer tube;

a radial gap between said inner tube and said outer tube, said gap being configured to provide capillary action to promote the transfer of water droplets between said inner and outer tubes and away from said mouthpiece;

said inner tube terminating below said mouthpiece tube in a one-way valve for permitting accumulated water in said inner tube to exit into said outer tube;

said outer tube extending below said inner tube to form a water reservoir below said inner tube; and said outer tube water reservoir having a one-way valve for purging water from said reservoir out of said outer tube.

2. The mouthpiece section recited in claim 1, said inner tube terminating in a one-way valve for permitting accumulated water in said inner tube to exit into said water reservoir.

3. The mouthpiece section recited in claim 2, the one-way valve of said outer tube and the one-way valve of said inner tube, being in spaced co-axial relation.

4. A snorkel comprising:

a conduit terminating at one end in an open top for extending above the surface of a body of water and having a second end terminating at a mouthpiece section permitting breathing through said conduit even while said mouthpiece section is beneath said surface;

said mouthpiece section being configured for reducing the accumulation of water from droplets falling along the interior surface of said conduit, said mouthpiece section having an outer tube and an inner tube, the inner tube residing co-axially within said outer tube and spaced therefrom to form a radial gap therebetween; and a mouthpiece extending radially from said outer tube and being connected by a mouthpiece tube to said inner tube;

said radial gap being configured to provide capillary action to promote the transfer of said droplets between said inner and outer tubes and away from said mouthpiece;

said inner tube terminating below said mouthpiece tube in a one-way valve for permitting accumulated water in said inner tube to exit into said outer tube;

said outer tube extending below said inner tube to form a water reservoir below said inner tube; and said outer tube water reservoir having a one-way valve for purging water from said reservoir out of said outer tube.

5. The mouthpiece section recited in claim 4, said inner tube terminating in a one-way valve for permitting accumulated water in said inner tube to exit into said water reservoir.

6. The mouthpiece section recited in claim 5, the one-way valve of said outer tube and the one-way valve of said inner tube, being in spaced co-axial relation.

* * * * *

UNITED STATES PATENT AND TRADEMARK OFFICE

CERTIFICATE OF CORRECTION

PATENT NO. : 8,166,968 B2
APPLICATION NO. : 11/593420
DATED : May 1, 2012
INVENTOR(S) : Dean R. Garraffa It is certified that error appears in the above-identified patent and that said Letters Patent is hereby corrected as shown below:

Column 1, line 35, delete “pure in” and insert therefor --purging--.

Column 3, line 20, delete “column as pressure” and insert therefor --column of pressure--.

Signed and Sealed this
Twenty-ninth Day of January, 2013

David J. Kappos

David J. Kappos
*Director of the United States Patent and Trademark Office*